US007393158B2

(12) United States Patent
Caldwell et al.

(10) Patent No.: US 7,393,158 B2
(45) Date of Patent: Jul. 1, 2008

(54) SHRINK FOR CENTRALIZER ASSEMBLY AND METHOD

(75) Inventors: Christopher S. Caldwell, The Woodlands, TX (US); Carl F. G. Baxter, Virum (DK); Robert E. Rose, Jr., Pearland, TX (US); Brent L. Dyer, Missouri City, TX (US); Michael Beard, Spring, TX (US)

(73) Assignee: RTI Energy Systems, Inc., Spring, TX (US)

( * ) Notice: Subject to any disclaimer, the term of this patent is extended or adjusted under 35 U.S.C. 154(b) by 0 days.

(21) Appl. No.: 10/689,472

(22) Filed: Oct. 20, 2003

(65) Prior Publication Data

US 2005/0084337 A1 Apr. 21, 2005

(51) Int. Cl.
*E21B 7/12* (2006.01)
*E21B 29/12* (2006.01)

(52) U.S. Cl. ..... 405/224.2; 405/216; 166/356; 166/241.6

(58) Field of Classification Search ..... 405/211, 405/216, 224.2; 166/341, 342, 356, 241.4, 166/241.6

See application file for complete search history.

(56) References Cited

U.S. PATENT DOCUMENTS 2,166,116 A * 7/1939 Bettis ..... 166/241.6
2,693,986 A * 11/1954 Phreaner ..... 166/241.4
3,442,558 A * 5/1969 Sable ..... 166/241.4
3,560,060 A * 2/1971 Morris ..... 166/241.4
3,727,954 A * 4/1973 Oliver ..... 285/146.3
4,185,694 A 1/1980 Horton ..... 166/350
4,624,484 A * 11/1986 Wilson ..... 285/45
4,633,801 A 1/1987 Marshall ..... 114/266
4,640,349 A * 2/1987 Allen ..... 166/68.5
4,858,688 A * 8/1989 Edwards et al. ..... 166/241.4
5,069,284 A * 12/1991 Gray ..... 166/311
5,336,020 A 8/1994 Askestad ..... 405/224
5,683,205 A * 11/1997 Halkyard ..... 405/224.2
5,797,455 A * 8/1998 Barron et al. ..... 166/241.6
5,803,170 A * 9/1998 Garcia-Soule et al. ... 166/242.3
5,810,100 A * 9/1998 Samford ..... 175/325.3
5,873,677 A 2/1999 Davies et al. ..... 405/195.1
6,305,723 B1 10/2001 Schutz et al. ..... 285/333
6,422,316 B1 7/2002 Schutz et al. ..... 166/367
6,422,791 B1 7/2002 Pallini, Jr. et al. ..... 405/224.2
6,467,545 B1 * 10/2002 Venkataraman et al. ..... 166/367

(Continued)

OTHER PUBLICATIONS

Spar Global Responses, Prepared for OGP Workshop—The Metocean and Engineering Technology Requirements for Floating Systems—Apr. 23, 2001, John Halkyard, CSO Aker Engineering, Inc., The Coflexip Stena Offshore Group.

*Primary Examiner*—Tara L. Mayo
(74) *Attorney, Agent, or Firm*—Browning Bushman P.C.

(57) ABSTRACT

A centralizer system is provided for use in a marine riser system, the centralizer being preferably heat-shrink fitted to an upset portion of a keel joint, the upset portion having tapered sections on the upper and lower ends that gradually blend into the outer diameter of the pipe used as the keel joint, the centralizer preferably comprising axially extending annular grooves in surrounding relationship to the upset portion, the grooves serving to permit forces acting on the centralizer to be redirected or dissipated to thereby prevent excessive buildup on a selected region of the upset portion adjacent the radial grooves.

11 Claims, 5 Drawing Sheets

U.S. PATENT DOCUMENTS 6,585,052 B2 * 7/2003 Angman et al. ..... 166/380
6,648,074 B2 * 11/2003 Finn et al. ..... 166/350
6,655,477 B2 * 12/2003 Appleton et al. ..... 175/325.3
6,666,267 B1 * 12/2003 Charlton ..... 166/241.6
6,679,325 B2 * 1/2004 Buytaert ..... 166/241.3
6,725,939 B2 * 4/2004 Richard ..... 166/384
6,739,415 B2 * 5/2004 Mitchell et al. ..... 175/325.5
2002/0084077 A1 7/2002 Finn et al. ..... 166/354
2003/0021634 A1 1/2003 Munk et al. ..... 405/224.2

* cited by examiner

FIG.1
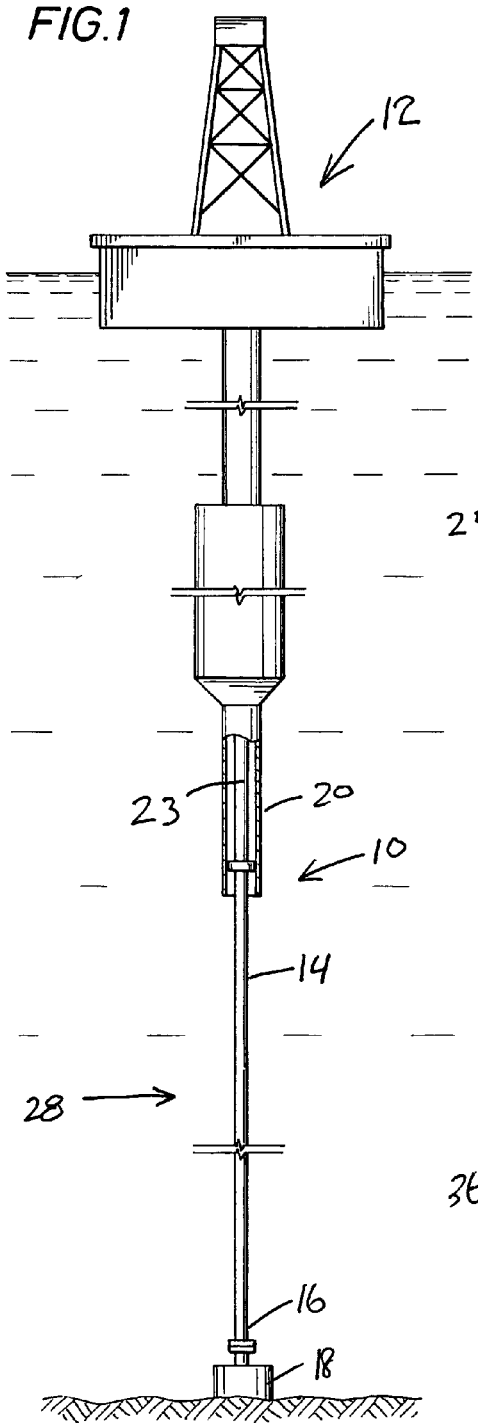
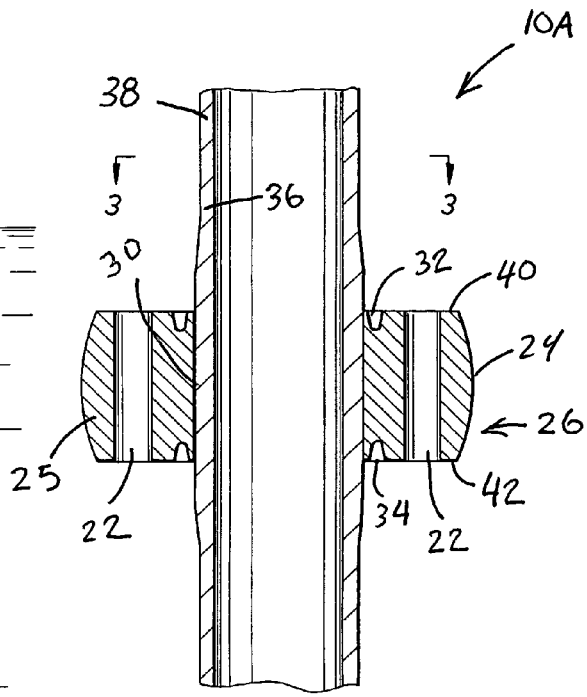
FIG. 2
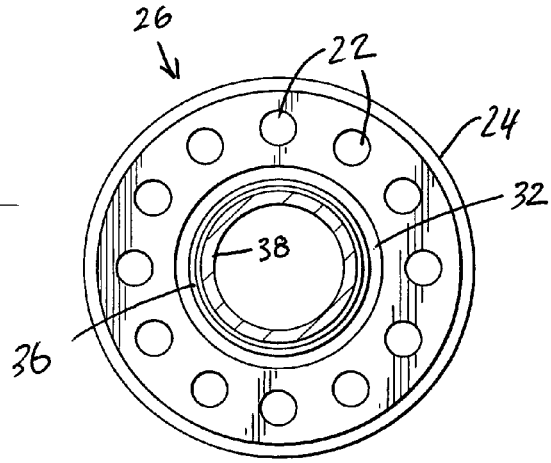
FIG. 3

SHRINK FOR CENTRALIZER ASSEMBLY AND METHOD

BACKGROUND OF THE INVENTION

1. Field of the Invention

The present invention relates generally to high-load centralizer systems and, more specifically, provides a system and method which in one preferred embodiment may be utilized as keel joint subject to substantial mechanical stresses in a marine riser system.

2. Description of the Prior Art

Marine risers have been utilized in the past with non-fixed connections to floating platforms and/or drill ships and/or wellheads that are maintained generally above the wellhead or in the vicinity of a plurality of wellheads. Stress joints may be utilized at the riser connections to the wellhead(s) and to the floating platform because large forces may be applied at these positions due to the relative movement between the wellhead and floating platform. The stress joint utilized at the floating platform is sometimes referred to as a keel joint because it extends through the bottom or the keel of the platform or other marine vessel. As used herein floating and/or offshore platform may refer to any marine structure for use with oil and gas wells. An example of a prior art keel joint is shown in U.S. Pat. No. 5,887,659 issued Mar. 30, 1999, to B. J. Watkins, which discloses an assembly including a protective sleeve spaced about an intermediate pipe of a riser which is adapted to extend through an opening in the bottom of a vertical compartment of a offshore rig for use in drilling or completing a subsea well, with a ball shaped portion on the upper end of the sleeve is closely received by ball shaped surfaces of the upper portion of the riser pipe, while a ball shaped part on the lower portion of the riser pipe is so received within the lower end of the sleeve to permit them to swivel as well as to move vertically with respect to one another.

A more general type of high stress marine riser interconnection is shown in U.S. Pat. No. 4,185,694, issued Jan. 29, 1980, to E. E. Horton which discloses a marine riser system which extends between a floating offshore platform and one or more well means in a seabed formation and which has riser end portions non-fixedly connected in to the floating platform and to wellhead structure at the well hole. Each end portion of the riser may be adapted to yield axially, laterally, and rotatively during movement of the riser relative to the platform and to the wellhead structure. Each end portion of the riser is provided with fulcrum or pivot contacts, which may preferably comprise centralizers, with hawse pipe carried by the platform and with hawse pipe or casing means provided in the wellhead structure. Bending stresses at the riser end portions or stress joints are reduced at the platform and at the wellhead structure by utilizing the non-fixed connection described therein.

Other attempts to control, reduce, minimize, and/or distribute forces applied to stress joints and/or keel joints are shown in the following documents:

U.S. Pat. No. 6,422,791, issued Jul. 23, 2002, to Pallini, Jr. et al., discloses an attachment which extends between an outer sleeve and an inner riser pipe where the pipe penetrates the keel of a platform. In one version, the attachment is a conically-shaped with a small diameter ring that engages the riser pipe and a large diameter ring that engages the outer sleeve. This attachment has elements that are very flexible in bending but relatively stiff and strong in axial load. Other versions include flat rings where lateral load is taken directly into tension and compression in the beams, allowing for relatively high lateral load transfer. Both the conically-shaped attachment and the flat ring have a number of variations that provide low bending stiffness but high axial stiffness of the elements. Depending on whether resistance to axial loads, lateral loads, or resistance to combination of both loads is desired, the attachment and the flat ring may be used alone or in combination. Other variations of the device provide two opposing conical shaped attachments or a conical and flat ring attachment installed together to provide load capability in both axial and lateral directions while still providing angular flexibility.

U.S. Pat. No. 5,683,205, issued Nov. 4, 1997, to J. E. Halkyard, discloses a stress relieving joint for pipe such as risers, tendons, and the like used in floating vessel systems wherein a vessel is subject to heave, pitch, and roll motion caused by wind, currents, and wave action; the pipe passing through a constraint opening in the vessel and connected to the sea floor and subject to bending or rotation at the constraint opening. The joint comprises a sleeve member of selected length with ends at opposite sides of the constraint opening and centralizing annuli or rings at sleeve member ends for providing spaced contact points or areas to distribute bending stresses imparted to the sleeve member at the constraint opening to the pipe at the sleeve member ends. A method of relieving or distributing stress in a pipe at a constraint location.

U.S. Pat. No. 5,873,677, issued Feb. 23, 1999, to Bavies et al., discloses a stress relieving joint for use with riser pipe in floating systems wherein a vessel is subject to variable motion caused by wind, currents, and wave action. The riser pipe has one end connectable to the sea floor and an upper portion adapted to pass through a constraining opening at the bottom of the vessel. A ball joint and socket assembly is removably attached to the keel at the constraint opening. A sleeve is attached at substantially its midpoint in the ball joint. Riser pipe received in the sleeve is provided with wear strips that reduces the rate of reduction in wear surface diameter.

U.S. Pat. No. 4,633,801, issued Jan. 6, 1987, to P. W. Marshall, discloses the apparatus of the present invention comprises a compliant structure for use in reducing bending stress at the ends of an elongated cylindrical tether which may, for example, be used to connect a floating platform supported by a body of water to the floor thereof. The apparatus comprises a plurality of tubular support members concentrically arranged about the elongated cylindrical tether at the tether's end connection. Each tubular support member is connected to each adjacent tubular support member in a manner that allows the entire assembly of tubular members to deflect in unison as the cylindrical tether deflects.

U.S. Pat. No. 6,467,545, issued Oct. 22, 2002, to Venkataraman et al., discloses a monolithic isolation stress joint is disclosed having a first conduit element, a first insulating joint assembly, and a stress joint connected to the first conduit element through the first insulating joint assembly. The stress joint is formed of a material which has advantageous elastic flexure characteristics but which is electrochemically active with respect to the first conduit element from which it is electrically isolated by the first insulating joint assembly. A second conduit element is connected to the stress joint through a second insulating joint assembly, the second conduit element being formed of a material which is electrochemically active with respect to the stress joint and which is electrically isolated therefrom with the second insulating joint.

U.S. Patent Application Publication 2002/0084077 A1, published Jul. 4, 2002, to Finn et al., discloses a spar type floating platform having risers passing vertically through the center well of a spar hull. A gimbaled table supported above the top of the spar hull is provided for supporting the risers. The table flexibly is supported by a plurality of non-linear springs attached to the top of the spar hull. The non-linear springs compliantly constrain the table rotationally so that the table is allowed a limited degree of rotational movement with respect to the spar hull in response to wind and current induced environmental loads. Larger capacity non-linear springs are located near the center of the table for supporting the majority of the riser tension, and smaller capacity non-linear springs are located near the perimeter of the table for controlling the rotational stiffness of the table. The riser support table comprises a grid of interconnected beams having openings therebetween through which the risers pass. The non-linear springs may take the form of elastomeric load pads or hydraulic cylinders, or a combination of both. The upper ends of the risers are supported from the table by riser tensioning hydraulic cylinders that may be individually actuated to adjust the tension in and length of the risers. Elastomeric flex units or ball-in-socket devices are disposed between the riser tensioning hydraulic cylinders and the table to permit rotational movement between the each riser and the table.

The above cited prior art does not disclose means for highly precise control of stresses and the distribution thereof in a centralized keel joint utilizing substantially solid metallic centralizers. Consequently, there remains a need to provide an improved centralizer system with improved centralizers and centralizer mountings that are not subject to the above problems. Those of skill in the art will appreciate the present invention, which addresses the above problems and other significant problems.

SUMMARY OF THE INVENTION

Accordingly, it is an objective of the present invention to provide an improved centralizer system especially suitable for non-fixed riser connections which may comprise or utilize stress joints such as a keel joint with a centralizer.

Another objective of one preferred embodiment of the present invention is to provide an improved system and method for affixing one or more centralizers to a stress joint.

Yet another objective of the another preferred embodiment of the present invention is to provide a substantially solid centralizer comprising structures therein for reducing forces applied to the stress joint or keel joint.

These and other objectives, features, and advantages of the present invention will become apparent from the drawings, the descriptions given herein, and the appended claims. However, it will be understood that above-listed objectives and other described advantages and features of the invention are intended only as an aid in understanding aspects of the invention, are not intended to limit the invention in any way, and therefore do not form a comprehensive or restrictive list of objectives, features, and/or advantages. Therefore, any stated objects, features, and advantages are not intended to limit the invention in any manner inconsistent with the claims or other portions of the specification and are not intended to provide limiting language outside of the claim language. It is intended that all alternatives, modifications, and equivalents included within the spirit of the invention and as defined in the appended claims be encompassed as a part of the present invention.

Accordingly, the present invention provides a centralizer system that may be positioned in a marine riser system connecting between one or more wellbores and a floating platform, the centralizer system being operable for withstanding stresses produced in the marine riser system by relative movement between the one or more wellbores and the floating platform and water motion. The centralizer system may comprise a metallic pipe comprising a pipe outer diameter less than the receptacle inner diameter so as to be insertable into the receptacle and relatively moveable within the receptacle and an upset portion formed on the metallic pipe having an upset outer diameter greater than the pipe outer diameter. A centralizer is preferably heat shrink mounted to the upset portion on the metallic pipe. The centralizer has an outer diameter less than the receptacle inner diameter for insertion into the receptacle.

The centralizer system may further comprise an upset transition zone on at least one side of the upset portion whereby the upset transition zone outer diameter decreases with distance axially away from upset portion and preferably blends into the pipe outer diameter. In one embodiment, the centralizer is also heat shrink mounted to at least a portion of the upset transition zone. The centralizer is preferably of rigid construction and may preferably utilize rigid solid steel construction. The centralizer may further comprise water flow ports to permit water flow therethrough as the centralizer moves axially with respect to the receptacle.

In a preferred embodiment, the centralizer defines and at least one preferably annular groove shaped (preferably with an axial component) to limit substantially radially directed forces from being transmitted through the rigid metal centralizer past or through the groove as a result of impact and/or forceful contact between the receptacle and the centralizer. The groove may be selectively positioned within the centralizer to reduce stress at a selected portion of the upset portion. For instance, the groove may be positioned adjacent to a first end of the upset portion to thereby reduce stress in the region of the first end of the upset portion. In another embodiment, two grooves are positioned adjacent opposite ends of the upset portion to thereby reduce stress at the opposite ends of the upset portion.

An insulative coating may be utilized on an outer surface of the centralizer to reduce corrosion, galvanic reactions, and/or dampen forces. The centralizer outer surface may comprise a curvature or substantially cylindrical surface for contact with the receptacle thereby affecting the stress applied to the upset portion in a desired manner.

A preferred method of the invention comprises heating the centralizer until the centralizer inner diameter is greater than the upset outer diameter and then positioning the centralizer over the upset outer diameter to thereby heat shrink affix the centralizer to the upset portion.

Reference to the claims, specification, drawings and any equivalents thereof is hereby made to more completely describe the invention.

BRIEF DESCRIPTION OF DRAWINGS

For a further understanding of the nature and objects of the present invention, reference should be had to the following detailed description, taken in conjunction with the accompanying drawings, in which like elements may be given the same or analogous reference numbers and wherein:

FIG. 1 is an elevational view, partially in cross-section, showing a keel joint riser interconnection with a floating platform in accord with one possible embodiment of the present invention;

FIG. 2 is an elevational view, in cross-section, of a tapered keel joint and shrink fitted centralizer in accord with one possible embodiment of the present invention;

FIG. 3 is a cross-sectional view along lines 3-3 of FIG. 2 in accord with one possible preferred embodiment of the present invention;

Figure 4:
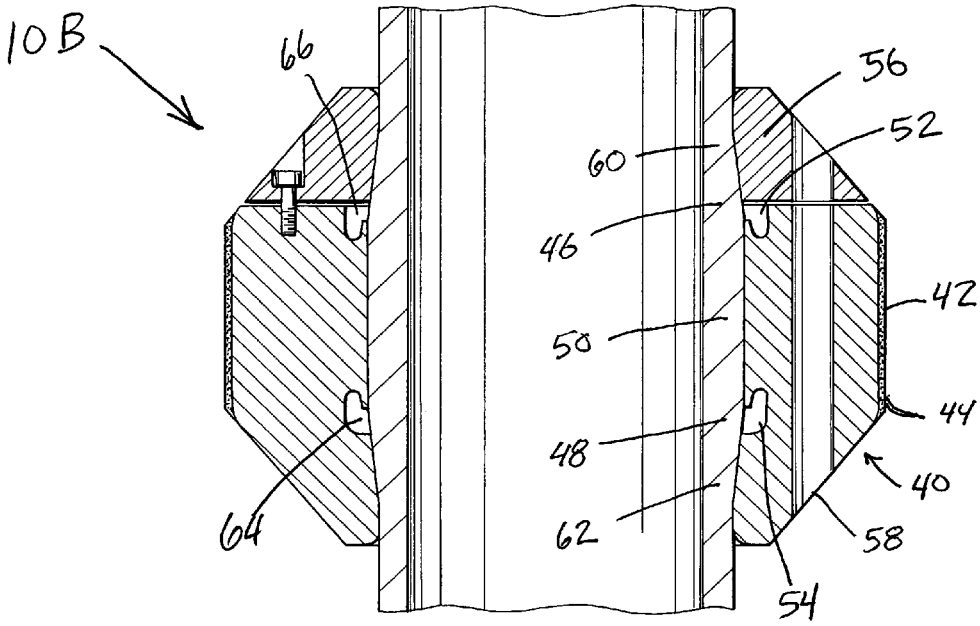
FIG. 4 is an enlarged elevational view, in cross-section, of a tapered keel joint and shrink fit centralizer with upper mounted guide section and stress relief grooves in accord with one possible embodiment of the present invention.

While the present invention will be described in connection with presently preferred embodiments, it will be understood that it is not intended to limit the invention to those embodiments. On the contrary, it is intended to cover all alternatives, modifications, and equivalents included within the spirit of the invention.

DETAILED DESCRIPTION OF THE PREFERRED EMBODIMENTS

Referring now to the drawings and, more specifically, to FIG. 1, there is shown an example of non-fixed riser connection comprising a tapered keel joint with a preferably shrink fit centralizer assembly 10 for interconnection with floating platform 12 in accord with the present invention.

Floating platform 12 in FIG. 1 is shown to provide a general conception of the background of operation of tapered keel joint with shrink fit centralizer assembly 10 in accord with the present invention and is not intended to represent the great variety in construction of numerous different types of floating platforms with various different features. Floating platform 12 may comprise various types of vessels which may include without limitation, as examples only, tension leg platforms, spars, barges, ships, and the like (see for Example U.S. Pat. No. 5,887,659) referenced hereinbefore. At some point or location, depending on the particular structure of floating platform 12, a receptacle or constraining opening such as conductor 20 is provided into which assembly 10 is inserted. One or more risers 28 with one or more shrink fit assemblies 10 may extend between floating platform 12 and one or more wellbores 18. Relatively greater stresses are produced at upper pipe/riser section 14 especially at the interconnection with conductor 20 and at lower riser section 16 at the interconnection with wellbore 18. The stresses are the result of loads as applied due to water currents, waves, surges, and various types of relative motion between floating platform 12 and wellhead 18.

Assembly 10 is designed to withstand the significant forces and to centralize the portion of the riser 23 above assembly 10 within conductor 20. One preferred embodiment of assembly 10 comprises shrink fit centralizer assembly 10A shown in greater detail in FIG. 2. In one preferred embodiment as shown in assembly 10A, centralizer 26 is shrink fitted to upset 30. By shrink fitting, it is meant that centralizer 26 is heated so as to expand and then be positioned around upset 30. Prior to heating, centralizer 26 may have an internal diameter slightly less than the outer diameter of upset 30. For instance, centralizer 26 may have an internal diameter of 12.240 inches prior to heating and upset 30 may have an outer diameter of 12.250 inches. To position the heated centralizer 26 at an exact position with respect to upset 30, removeable stops (not shown) may be mounted or clamped to pipe 38 which provide stop surfaces to thereby place centralizer 26 at the exact desired position around upset 30. Centralizer 26 may then be evenly and slowly heated, such as in an oven or the like to a relatively high temperature without damaging desired metal characteristics, e.g., in the range of 475-500 degrees Fahrenheit. The centralizer 26 may then be slipped over the pin end of pipe 38 until engaging the removable stop surface to thereby align centralizer 26 at the desired position around upset 30. Sufficient cooling to fasten centralizer 26 to upset 30 may take approximately five minutes or so at room temperature whereby centralizer 26 is then securely fastened to upset 30.

Utilizing heat shrink construction has many advantages. It is much less expensive than machining, and just as strong. Machining the centralizer and keel joint out of a single piece of material would be quite expensive. It is much simpler and more cost effective to machine the keel joint with upset and the centralizer separately and then heat shrink fit the centralizer onto the upset position of the centralizer. Also, for stress design purposes, it is much easier to predict exactly where the stresses will be applied because the relative location of centralizer 26 and upset 30 is more exactly defined than is the case where the centralizer is simply bolted on because there is essentially no movement whatsoever. Slight movement may occur to bolted on centralizer structures especially due to the anticipated high stresses applied thereto during operation, which movement can vary over time due to changes in the bolted connection. However the present invention does not preclude the possibility of bolting centralizer 26 on or otherwise mounting such as by welding, or heat shrinking and then welding and/or bolting. In any case, due to the shrink fit construction, there is virtually no axial movement. Even very slight movements as may occur by other mounting methods such as bolting are reduced or eliminated thereby permitting a much more exact stress analysis and resulting improved, more efficient, more reliable, and less expensive design construction.

In operation, tapered keel joint with shrink fit centralizer assembly 10A is inserted into conductor 20 and may move axially with respect to conductor 20. Referring to FIG. 2 and FIG. 3, water flow passageways 22 may be utilized to reduce or limit any hydraulic forces that resist axial movement of tapered keel joint with shrink fit centralizer assembly 10 with respect to conductor 20. Resistance to axial movement might otherwise occur especially if centralizer maximum outer diameter 24 of centralizer 26 for assembly 10A is of relatively close tolerance to the inner diameter or smallest restrictions of conductor 20. Due to tensioners and/or air cans and/or telescoping joints utilized by floating platform 12, which control the tension in riser 28 (see FIG. 1), it may therefore be desirable to avoid or limit the creation of additional axial forces acting on riser 28, by utilizing water flow passageways 22, to relieve any hydraulic forces created thereby.

As noted hereinbefore, tapered keel joint with shrink fit centralizer assembly 10A is a type of stress joint which is designed to handle the significantly greater forces created on the riser at the points of contact of riser with floating platform 12 and wellhead 18. Stress joints may be comprised of various materials, e.g. steel or titanium. Although in assembly 10A, a preferred embodiment is comprised of steel, the present invention is not limited to steel. In the embodiment of assembly 10A, the keel joint comprises a reinforced thickened exterior wall or upset 30 with a selected tapered portion 36. Due to the various types of floating platforms involved and the various constructions thereof, the types of forces involved with non-fixed riser interconnections may vary considerably. Accordingly, to handle the various types of anticipated stresses that may be experienced by assembly 10A, the general configuration of assembly 10A and the components thereof such as centralizer 26 and preferably upset 30 may be varied as desired.

It is desirable that assembly 10 absorb the maximum stress applied to riser 28. By utilizing the components of assembly 10A, it is possible to control, direct, and/or spread the stress forces to thereby place maximum stresses at the strongest regions of assembly 10A and reduce or minimize forces applied to other components thereby providing a lower cost, more efficient, and longer lasting assembly 10.

In one preferred embodiment of the invention, it may be desirable to control forces applied to upset 30 by limiting and/or directing some forces within centralizer 26 itself. One possible presently preferred embodiment of the invention utilizes shaped grooves within centralizer 26 to control stress by preferably significantly reducing maximum stresses that are applied to the upper and lower ends of upset 30 as compared to not utilizing the grooves. In the embodiment of FIG. 2, relief grooves 32 and 34 may formed in the upper and lower surfaces of centralizer 26 to thereby limit the force transmitted through upper surface 40 and lower surface 42 of centralizer 26 with respect to the corresponding upper and lower portions of upset 30. In this case, stress relief grooves 32 and 34 preferably comprise an axial shape component in that a significant portion of grooves 32 and 34 is oriented laterally aligned and preferably substantially parallel to the central axis of assembly 10 thereby limiting the maximum substantially laterally forces transmitted along the upper and lower surfaces and applied to upset 30 as a result of impact or hard pressure contact with receptacle 20. The axial orientation of grooves 32 and 34 is therefore significant for limiting lateral forces and highly useful for controlling stresses applied to upset 30 as the result of generally laterally directed forces which include rolling lateral forces due to water motion impact and forceful contact pressures between centralizer and conductor 20. As well the positioning of grooves 32 and 34 closer to upset 30 assists in this function especially due to bending loads applied to centralizer 26 which may vary depending on whether centralizer 26 has a more tapered or a more cylindrical profile when viewed in elevation. Various additional groove constructions for centralizer 26 are also discussed hereinafter.

In embodiment 10A shown in FIG. 2, centralizer outer diameter 24 is curved or arced or circular, as indicated at 25 which may be desirable for several types of operating environments. A curved surface 24 is useful for guiding assembly 10A into conductor 20 and/or for guiding assembly 10A by any restrictions that may be found within conductor 20. Curved outer surface 25 may also be utilized to limit friction with conductor 20. The width of centralizer 30 may be utilized to spread the stresses over upset 30, and the length of upset 30 may be varied as well. The point contact of curved surface 24 may be more useful in anticipating and modeling forces than a cylindrical surface. A purely lateral or slight rolling lateral contact at or near the maximum OD 24 of rounded outer diameter centralizer 26, which will occur near the axial center of centralizer 26, may also tend to direct a substantial portion of the force of contact towards the central portion of upset 30, i.e., the strongest portion of upset 30, while reducing the stresses applied to the upper and lower portions of upset 30. In this way, the stresses at the ends of upset 30 are then reduced and tend to further decrease in transition zones 36 where the minimized forces are applied to the remainder of the keel joint through blended upset transition zones.

Thus, for assembly 10A, the combination of a tapered centralizer mounted to upset 30, may provide a more even distribution of forces than if centralizer 26 were provided with a purely cylindrical profile which might tend to produce significantly higher maximum forces adjacent the upper and lower surfaces of centralizer 26 especially due to angled contact with conductor as may be produced by rolling waves and the like, whereby these maximum forces are applied to the upper and lower portions of upset 30 resulting in higher stress distributions and significant changes during operation to those distributions for the remainder of the keel joint thereby increasing the possibility of fatigue and/or operating life.

As explained in examples given hereinbefore and hereinafter, it will be appreciated by those of skill in the art that the present invention provides a variety of functional features that may be utilized as tools as discussed for selectively controlling, directing, and/or spreading stresses depending on the expected operating conditions. Various types of specially developed stress analysis computer simulation programs such as finite element analysis codes may be utilized to simulate and/or special testing facilities may be utilized to simulate the physical responses expected from a particular floating platform/marine riser system construction. Therefore, depending on the environment of operation, the design of upset 30 and centralizer 26 may vary considerably. Accordingly, once the anticipated stresses to applied are known, then the various specific design features as taught herein may be utilized to provide a better operating, longer lasting, more fatigue resistant, less expensive, and more reliable keel joint.

As mentioned briefly above, another presently preferred feature of one possible preferred embodiment of shrink fit centralizer assembly 10, is that upset 30 may preferably utilize a tapered or blended region 36 between the thickest portion of upset 30 and remaining relatively narrower or nominal size tubular wall 38 of assembly 10 to thereby minimize the forces applied to the narrower tubular wall 38. Depending on the types of forces, various types of tapers 36 or blended upset portions may be utilized as illustrated in FIG. 8-13 discussed hereinafter. Upset 30 may be cylindrical as in convenient for heat shrink mounting but could also be comprised of different shapes, if desired.

While the above discussed features of oriented centralizer grooves, tapered or blended upset regions, and shrink fit centralizer to stress joint 38, and subsequently discussed features, may be utilized in combination for synergistic effects as illustrated in some presently preferred embodiments discussed herein, it will be understood that each of these features are important in themselves and may be utilized effectively separately, in various combinations, and/or in combination with other constructions to effect desirable results.

Assemblies 10B, 10C, 10D, and 10E, shown respectively in FIG. 4, FIG. 5, FIG. 6, and FIG. 7 illustrate other embodiments, variations, and features of the present invention.

Assembly 10B provides centralizer 40 which has a straight outer profile or cylindrical outer surface 42. Outer surface 42 may comprise an insulative coating 44 electrically insulative and/or water tight sealing insulative coating 44 such as an elastomeric coating to avoid potential problems with corrosion and/or galvanic action of two dissimilar metals. Coating 44 may be comprised of various types materials such as elastomerics or other suitable insulative materials some of which maybe at least somewhat flexible, compressible, resilient, and/or at least more pliable than steel. Coating 44 may be relatively thick as desired to provide shock insulation. Coating 44 may also comprise composite materials that are electrically nonconductive and provide high load-bearing, fatigue-resistant interface between centralizer 40 and receptacle 20 in which centralizer 40 may operate (see FIG. 1). If a composite is used, the composite could be comprised of reinforcing filler supported in a polymeric matrix selected from a group consisting of thermoplastic resins, thermosetting resins, and mixtures thereof. Non-limiting examples of reinforcements thereof may comprise fibers such as glass fibers, aramid fibers, boron fibers, continuous fibers. Fiber reinforced coatings may be laminated and/or molded.

Even though outer surface 42 of centralizer 40 is cylindrical, the earlier mentioned problems of stress produced at the tops and bottoms of the centralizer and at the corresponding upper portion 46 and lower portion 48 of upset 50 are reduced by means of stress relief grooves 52 and 54 as well as upper annular guide 56 and lower annular guide 58, which is integral with shrink fit centralizer 40. Stress relief grooves 52 and 54 limit lateral forces applied through centralizer 40 to corresponding upper and lower portions 46 and 48 of upset 50 as explained before. Upper guide 56 and lower guide 58 also spread the forces over a wider area including the entire upset including upper transition zone 60 and lower transition zone 62. Thus, large stresses at upper and lower portions 46 and 48 of upset 50 are reduced and the stress along upset 50 is more uniform. Guide 56 and lower guide 58 also provide additional axial movement guidance of assembly 10B as may be useful for axial movement into and within receptacle 20. Stress relief grooves 52 and 54 utilize both an axially oriented portion 64 and a radially oriented portion 66 which reduces stress at upper and lower portions 46 and 48 of upset 50 for purely lateral forces as well as for bending forces whereby the forces tend to be directed more towards the central portion of upset 50 as is desirable.

Figure 5:
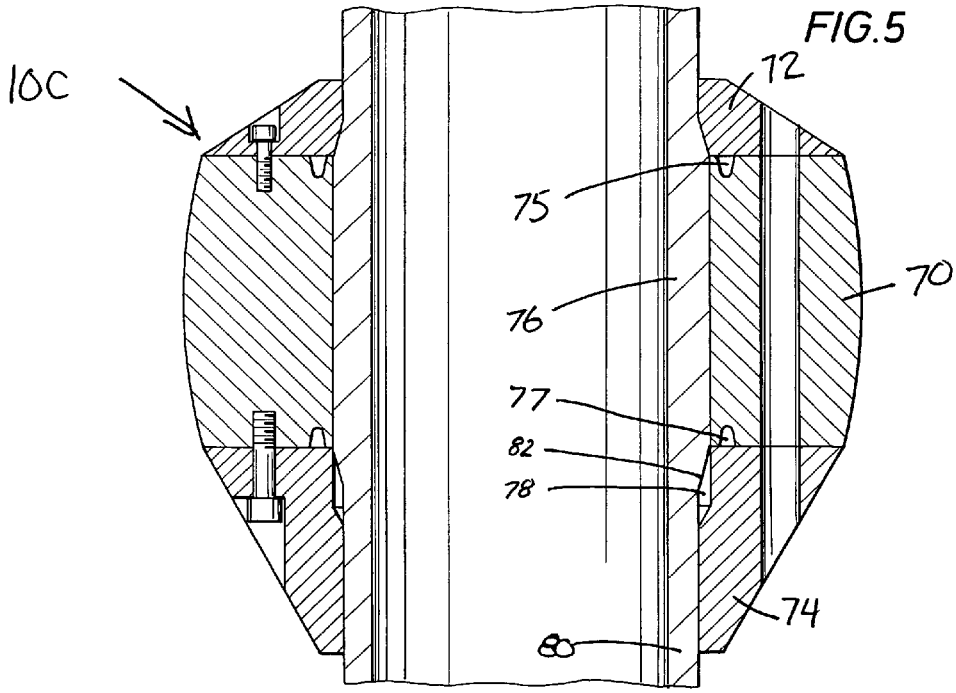
FIG. 5 is an elevational view, partially in cross-section, of a tapered keel joint and shrink fit centralizer with upper and lower guide sections and axially oriented stress relief grooves in accord with one possible embodiment of the present invention.
Figure 6:
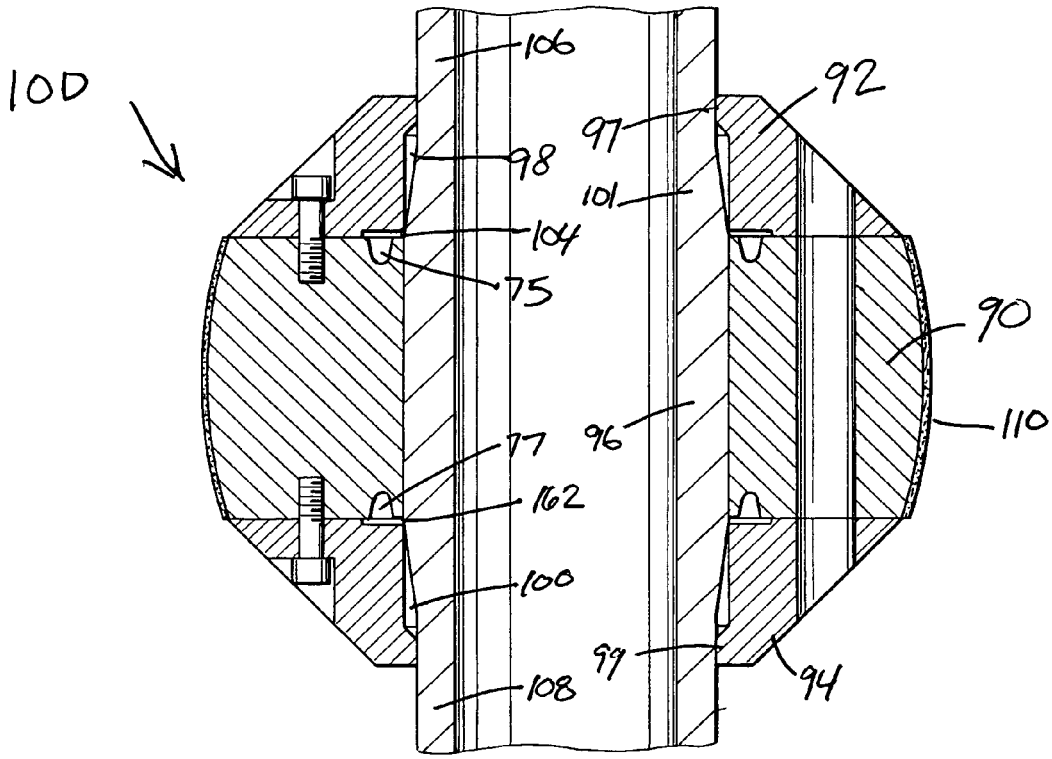
FIG. 6 is an elevational view, partially in cross-section, of a tapered keel joint and shrink fit centralizer with upper and lower guide sections providing an annulus around upper and lower tapered keel joint portions in accord with one possible embodiment of the present invention.
Figure 7:
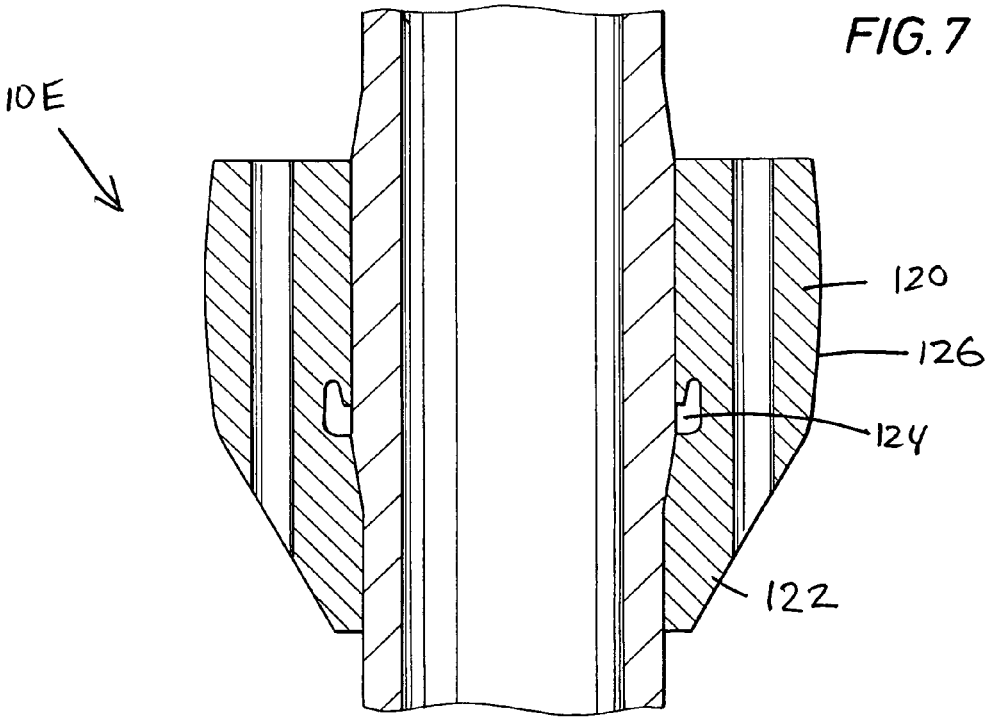
FIG. 7 is an elevational view, partially in cross-section, of a tapered keel joint and shrink fit centralizer and monolithic lower guide section with stress grooves having radially and axially oriented portions in accord with one possible embodiment of the present invention.
Figure 8:
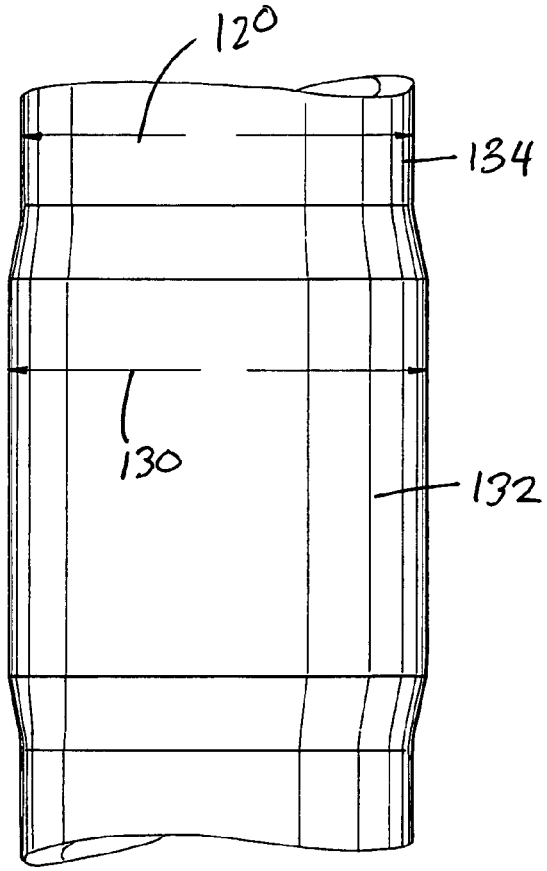
FIG. 8 is an elevational view of a tapered keel joint in accord with an upset portion one possible embodiment of the present invention.
Figure 9:
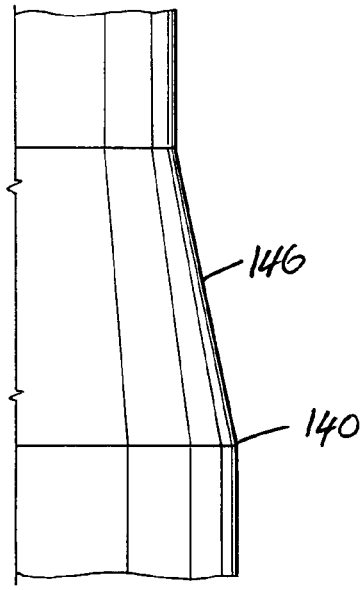
FIG. 9 is an enlarged elevational view of a tapered keel joint with a conically tapered upset portion in accord with one possible embodiment of the present invention.
Figure 10:
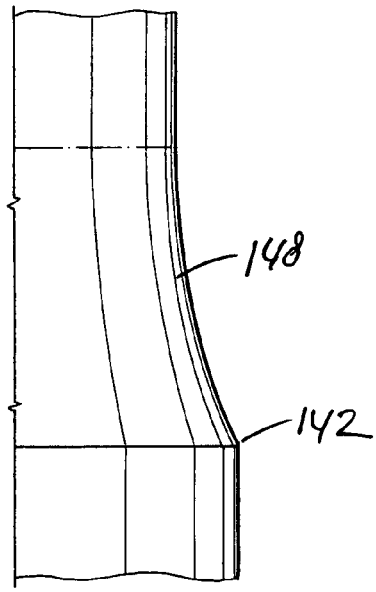
FIG. 10 is an enlarged elevational view of a tapered keel joint with a gradually variably tapered upset portion in accord with one possible embodiment of the present invention.

Assemblies 10C and 10D, in FIG. 5 and FIG. 6, utilize similar shrink fit rounded edge centralizer portions 70 and 90 as centralizer 24 of assembly 10A. However, upper guides 72, 92 and lower guides 74, 94 are utilized. The widths of centralizers 70 and 90 are larger with respect to the length of the corresponding upsets 76 and 96 as compared to upset 30, thereby providing additional stress spreading. Axially oriented grooves 75 and 77 limit stress applied to upper and lower portions of upset 76. Axially oriented groves may be formed at other positions that the top and bottom of the centralizer, if desired, as previously shown in FIG. 10B, for desired stress control, directing, spreading. Annular opening 78 around lower upset transition region 82 permits greater flexibility for anticipated flexing needs of lower tubular 80.

In FIG. 6, annular openings 98 and 100 at both upper and lower upset transition zones plus radially oriented grooves 102 and 104 permit additional flexibility of upper and lower pipe sections 106 and 108 for system 10D. Upper and lower contact surfaces 97 and 99 spread some already significantly reduced stresses due contact with surface 110 to pipe sections 106 and 108 thereby enhancing stress reducing operation of upset transition zones 101 and 103. Insulation layer 110 reduces corrosion, galvanic reactions, and/or shocks.

Assembly 10E provides yet another embodiment of a shrink fit centralizer 120 whereby forces tend to be more greatly minimized over the lower portions due to lower guide 122, lower positioned slot 124, and round outer surface 126. This embodiment might be preferred under operating conditions where contact with cylinder 20 or obstructions therein is more likely to occur adjacent the lower portion of centralizer 120.

Thus, the above assemblies 10A-10E provide various advantages depending on predicted operating conditions.

As alluded to hereinbefore, additional means for controlling, directing, and/or spreading stresses is provided utilizing different upset transition zones as illustrated in FIG. 8, FIG. 9, FIG. 10, FIG. 11, FIG. 12, and FIG. 13 whereby the outer diameter varies from the outmost diameter 130 to of upset 132 to the nominal outer diameter 134 of the pipe. Computer analysis of the expected operating forces may be utilized to select the most desirable transition zone along with cost/benefit considerations. Blended or gradual changes over larger areas are more likely to absorb/spread bending stresses. Sharper edges may be utilized where less bending is anticipated because stress concentrations tend to be increased at sharper edges. However, cost may be a factor since there may be no cost justification to machine a more gradual change in the upset. On the other hand, in some circumstances it may be desirable to avoid any sharper points at all as indicated FIG. 12 which actually comprises a convex and concave upset transition zone which results in more gradual or uniform stresses. Further more complicated shapes may also be utilized.

Figure 13:
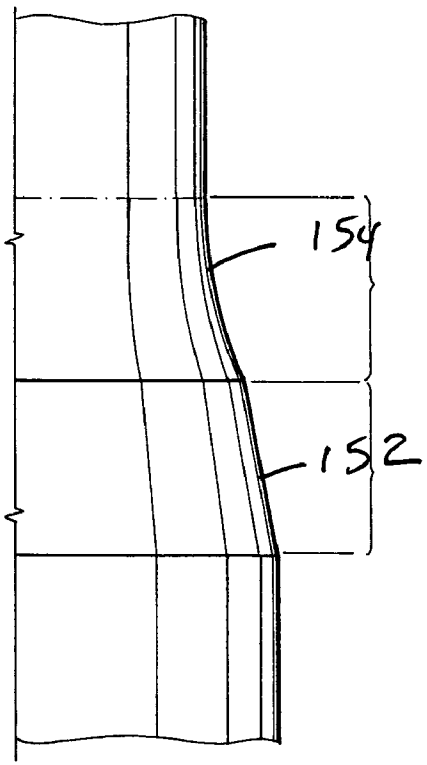
FIG. 13 is an enlarged elevational view of a tapered keel joint with a straight conical and curved tapered upset portion in accord with one possible embodiment of the present invention.
Figure 12:
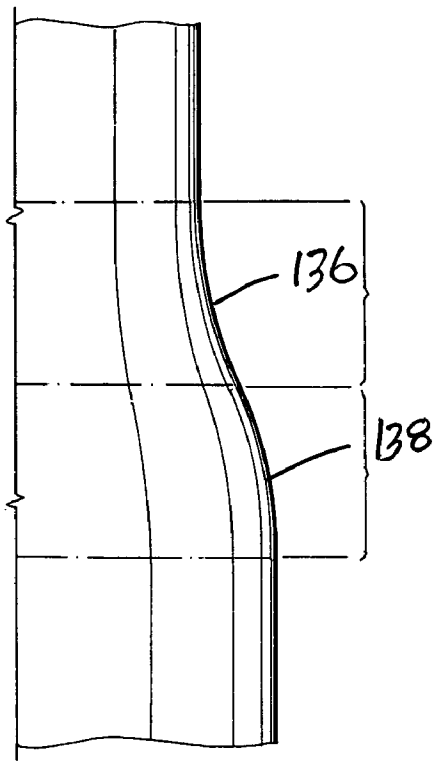
FIG. 12 is an enlarged elevational view of a tapered keel joint with two different curvatures in a tapered upset portion in accord with one possible embodiment of the present invention.
Figure 11:
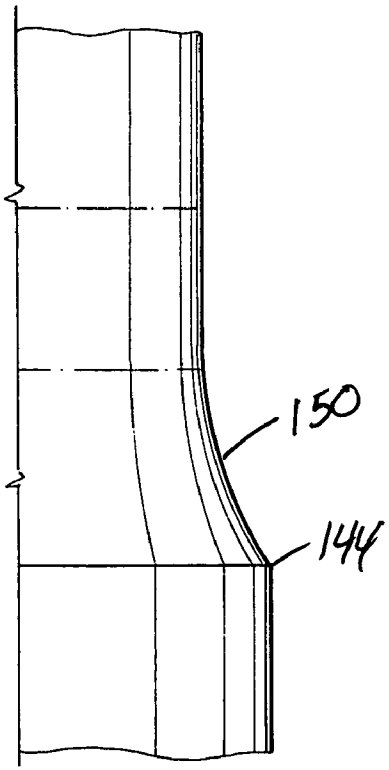
FIG. 11 is an enlarged elevational view of a tapered keel joint with a shortened variably tapered upset portion as compared to the embodiment of FIG. 10 in accord with one possible embodiment of the present invention.

Sharper edges such as shown at 140, 142, 144, (FIG. 9, FIG. 10, and FIG. 11) may be utilized when forces are well within desired tolerances and wherein it is desired that stresses drop off or blend into the nominal wall thickness at various rates of change as provided by conical transition zone 146 (FIG. 9), gradual concave transition zone 148, (FIG. 10), and sharper concave transition zone (FIG. 11). FIG. 13, provides a two stage upset transition zone 152 and 154 as may be most appropriate in anticipation certain operating conditions. Additional stages may be utilized, if desired.

The above features including grooves such as axially oriented grooves, shrink fit centralizers, tapered transition zones may be adjusted and utilized in various ways to meet anticipated operating conditions to provide durable long-lasting keel joints. The above embodiments are given only as examples. Grooves may be varied in size and location, for instance axially oriented grooves may be positioned adjacent upset portions at which it is desired to reduce stresses or make them more uniform. Bending stresses at anticipated bending portions of the keel joint may be reduced by more gradual or tapered upset transition zones. The design of the centralizer, the outer surfaces thereof, the position and type of stress grooves, the width of the centralizer, the length of the upset and length and type of transition zone are all tools that may be flexibly utilized as discussed hereinbefore to provide an improved keel joint. The larger portions of the upsets shown above are generally cylindrical but could take other shapes as desired as may need coordination with shrink fitting of the centralizer and costs thereof.

Accordingly, the present invention provides shrink fit centralizer assemblies of various types which may are especially useful as stress joints for absorbing the high stresses associated with keel joints and other riser interconnections. The invention relates to stress joints such as a keel joint having an upset with a centralizer that is shrink-fitted to the upset portion of the keel joint. The keel joint has an upset, generally cylindrical, which has tapered sections on the upper and lower ends thereof, which in some embodiments gradually blend into the OD of the pipe sections above and below the upset.

The foregoing disclosure and description of the invention is therefore illustrative and explanatory of a presently preferred embodiment of the invention and variations thereof, and it will be appreciated by those skilled in the art that various changes in the design, organization, order of operation, means of operation, equipment structures and location, methodology, and use of mechanical/insulative/cathodic equivalents, as well as in the details of the illustrated construction or combinations of features of the various elements, may be made without departing from the spirit of the invention. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size and arrangement of the components may be greatly different from that shown and still operate within the spirit of the invention as described hereinbefore and in the appended claims. It will be seen that various changes and alternatives may be used that are contained within the spirit of the invention.

Accordingly, because many varying and different embodiments may be made within the scope of the inventive concept (s) herein taught, and because many modifications may be made in the embodiment herein detailed in accordance with the descriptive requirements of the law, it is to be understood that the details herein are to be interpreted as illustrative of a presently preferred embodiment and not in a limiting sense.

What is claimed is:

1. A centralizer system for positioning in a marine riser system, said marine riser system connecting between one or more wellbores and a floating platform, comprising:

a receptacle for receiving said centralizer system, said receptacle having a receptacle inner diameter;

a metallic pipe comprising a pipe outer diameter less than said receptacle inner diameter so as to be insertable into said receptacle and relatively moveable within said receptacle;

a metallic upset portion formed on said metallic pipe having an upset outer diameter greater than said pipe outer diameter, said pipe and said upset portion being a monolithic structure;

a metallic centralizer heat shrink mounted on and in rigid gripping engagement with said upset portion on said metallic pipe whereby said centralizer and said upset are prevented from any relative movement, said centralizer having an outer diameter less than said receptacle inner diameter for insertion into said receptacle and serving to centralize said metallic pipe and centralizer in said receptacle said upset portion and said centralizer being wholly received in said receptacle, said pipe, said upset portion, and said centralizer being freely, axially moveable relative to and within said receptacle.

2. The centralizer system of claim 1, further comprising an upset transition zone on at least one side of said upset portion, said upset transition zone having an outer diameter equal to said upset portion on one end of said upset transition zone such that said outer diameter of said upset transition zone decreases with distance axially away from said upset portion.

3. The centralizer system of claim 2, wherein said centralizer is also in gripping engagement with at least a portion of said upset transition zone.

4. The centralizer system of claim 1, wherein said centralizer is monolithic and further comprises water flow ports to permit water flow therethrough as said centralizer moves axially with respect to said receptacle.

5. The centralizer system of claim 1, wherein said centralizer is rigid, said centralizer defining at least one groove shaped to limit substantially radially directed forces created due to impact or high force contact of said receptacle by said centralizer.

6. The centralizer system of claim 5, wherein said at least one groove is selectively positioned within said centralizer to thereby selectively reduce stress at a selected portion of said upset portion.

7. The centralizer system of claim 6, wherein said at least one groove is positioned adjacent to a first end of said upset portion to thereby reduce stress at said first end of said upset portion.

8. The centralizer of claim 7, further comprising two grooves positioned adjacent opposite ends of said upset portion to thereby reduce stress at said opposite ends of said upset portion.

9. The centralizer system of claim 1, further comprising an insulative coating on an outer surface of said centralizer.

10. The centralizer system of claim 1, wherein said centralizer has an outer surface with a curvature portion for contact with said receptacle.

11. The centralizer system of claim 1, wherein said centralizer has a substantially cylindrical outer surface portion for contact with said receptacle.

* * * * *

UNITED STATES PATENT AND TRADEMARK OFFICE

CERTIFICATE OF CORRECTION

PATENT NO. : 7,393,158 B2
APPLICATION NO. : 10/689472
DATED : July 1, 2008
INVENTOR(S) : Christopher S. Caldwell et al.

It is certified that error appears in the above-identified patent and that said Letters Patent is hereby corrected as shown below:

ON THE TITLE OF THE PATENT:

Item (54):

Please change "SHRINK FOR CENTRALIZER ASSEMBLY AND METHOD" to

--SHRINK FIT CENTRALIZER ASSEMBLY AND METHOD--

Column 1, line 1, change "SHRINK FOR CENTRALIZER ASSEMBLY AND

METHOD" to --SHRINK FIT CENTRALIZER ASSEMBLY AND METHOD--

Signed and Sealed this

Second Day of December, 2008

JON W. DUDAS
*Director of the United States Patent and Trademark Office*